United States Patent [19]

Nakai et al.

[11] Patent Number: 5,033,587

[45] Date of Patent: Jul. 23, 1991

[54] BRAKING SYSTEM FOR A LINEAR MOTOR DRIVEN ELEVATOR

[75] Inventors: Keiichiro Nakai, Tokyo; Manabu Suganuma, Narita, both of Japan

[73] Assignee: Otis Elevator Company, Farmington, Conn.

[21] Appl. No.: 493,575

[22] Filed: Feb. 26, 1990

[30] Foreign Application Priority Data

Feb. 28, 1989 [JP] Japan ..... 1-49724

[51] Int. Cl.[5] ..... B66B 1/32

[52] U.S. Cl. ..... 187/77; 187/73; 187/108

[58] Field of Search ..... 187/108, 109, 73, 77, 187/1 R, 94

[56] References Cited

U.S. PATENT DOCUMENTS 684,390 10/1901 Venn ..... 187/94
826,558 7/1906 Furlow ..... 187/94
3,613,835 10/1971 Vizzotto ..... 187/108
3,768,597 10/1973 Darwent et al. ..... 187/77
4,570,753 2/1986 Ohta et al. ..... 187/1 R

*Primary Examiner*—David H. Bollinger
*Assistant Examiner*—S. Kennemore
*Attorney, Agent, or Firm*—Lloyd D. Doigan

[57] ABSTRACT

A linear motor driven elevator system comprises: a car connected to a counterweight by a rope; a linear motor comprised of a primary conductor and secondary conductor, one of which is a moving element and the other being a stator, the moving element being mounted in the car or the counterweight; and a device for stopping the car comprising, a power source connected to the primary conductor, the power source being continuously fed to the primary conductor to move the car and not being fed to the primary conductor to stop the car, and a braking device mounted on the car, the braking device being disengaged when power is fed to the primary conductor and engaged when power to the primary conductor is interrupted.

8 Claims, 5 Drawing Sheets

BRAKING SYSTEM FOR A LINEAR MOTOR DRIVEN ELEVATOR

DESCRIPTION

1. Technical Field

This invention relates to elevator braking systems and more particularly to braking system for a linear motor driven elevator.

2. Background Art

Conventional elevators typically employ a rotary induction motor to provide motive power. The motor drives a sheave over which a rope is disposed. A first end of the rope attaches to a car and a second end of the rope attaches to a counterweight. Traction between the rope and the sheave causes the car and counterweight to move.

The elevator stops a car at a floor in accordance with a control of electric power fed from a control circuit, including a inverter circuit or the like. The car is stopped at a given floor by applying a braking force on the sheave. Further, the car has a built-in braking device for emergency braking. The braking device engages a guide rail to prevent the car from descending upon a power outage or rope shear. A machine room, which houses the motor and sheave, is disposed above the elevator.

On the other hand, an elevator driven by a linear motor places the linear motor in the car or the counterweight. As a result, a different device for stopping and resting the car at a desired floor is required because the motor itself cannot stop and rest the car at the floor. The machine room above a linear driven elevator may be much smaller than a machine room for a rotary motor driven elevator because of the location of the motor in the linear motor driven elevator.

Japanese Patent Laid Open No. 48-53543 discloses an elevator braking device wherein movement of the rope is stopped by a braking device acting on a sheave used in a winding machine-type elevator. Japanese Patent Laid Open No. 63-117884 discloses a stopping device having a braking device mounted in a counterweight for stopping a car at the requested floor.

The brake disclosed in Japanese Patent Laid Open No. 48-53543 requires sufficient friction between the sheave and the rope. The braking load applied on the sheave thus must be large enough to meet the requirement. In such a system, it is difficult to simplify the upper portion of the elevator (i.e. downsize the machine room), which is made possible by using a linear motor. The construction shown in Japanese Patent Laid Open No. 63-117884 simplifies the upper portion of the elevator, but makes maintenance of the braking device fairly burdensome. If the braking device malfunctions and stops the car when the counterweight is located at a floor other than the lower most floor, maintenance of the braking device is difficult and dangerous. Moreover, since wear of the braking device is great, malfunction thereof is probable.

DISCLOSURE OF THE INVENTION

It is an object of the invention to provide a device for stopping a linear motor driven elevator.

It is a further object of the invention to provide a device for stopping a linear motor driven elevator which is easy to maintain.

According to the invention, a linear motor driven elevator system comprises: a car connected to a counterweight by a rope; a linear motor comprised of a primary conductor and secondary conductor, one of which is a moving element and the other being a stator, the moving element being mounted in the car or the counterweight; and a device for stopping the car comprising, a power source connected to the primary conductor, the power source being continuously fed to the primary conductor to move the car and not being fed to the primary conductor to stop the car, and a braking device mounted on the car, the braking device being disengaged when power is fed to the primary conductor and engaged when power to the primary conductor is interrupted.

According to an aspect of the invention the braking device comprises a brake shoe which frictionally engages a guide rail which guides the car, and an actuator for engaging the brake shoe with the guide rail or disengaging the brake shoe from the guide rail, the actuator disengaging the brake shoe while power is fed to the primary conductor and engaging the brake shoe when power fed to the primary conductor is interrupted. Preferably the braking device is switched to the braking position when a power outage or earthquake occurs. The counterweight may have an auxiliary braking device mounted thereon if prevention of inertial travel thereof is required. Likewise, the sheave may also have an auxiliary braking device appended thereto.

The foregoing stopping device activates the linear motor to provide motive force to the elevator system in accordance with hall calls or car calls and interrupts feeding power to the linear motor when the car arrives at a desired. At a given time, the braking device is engaged to guide the car to the proper resting point. The auxiliary braking device provided in the counterweight may be operated in synchronization with that provided in the car.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
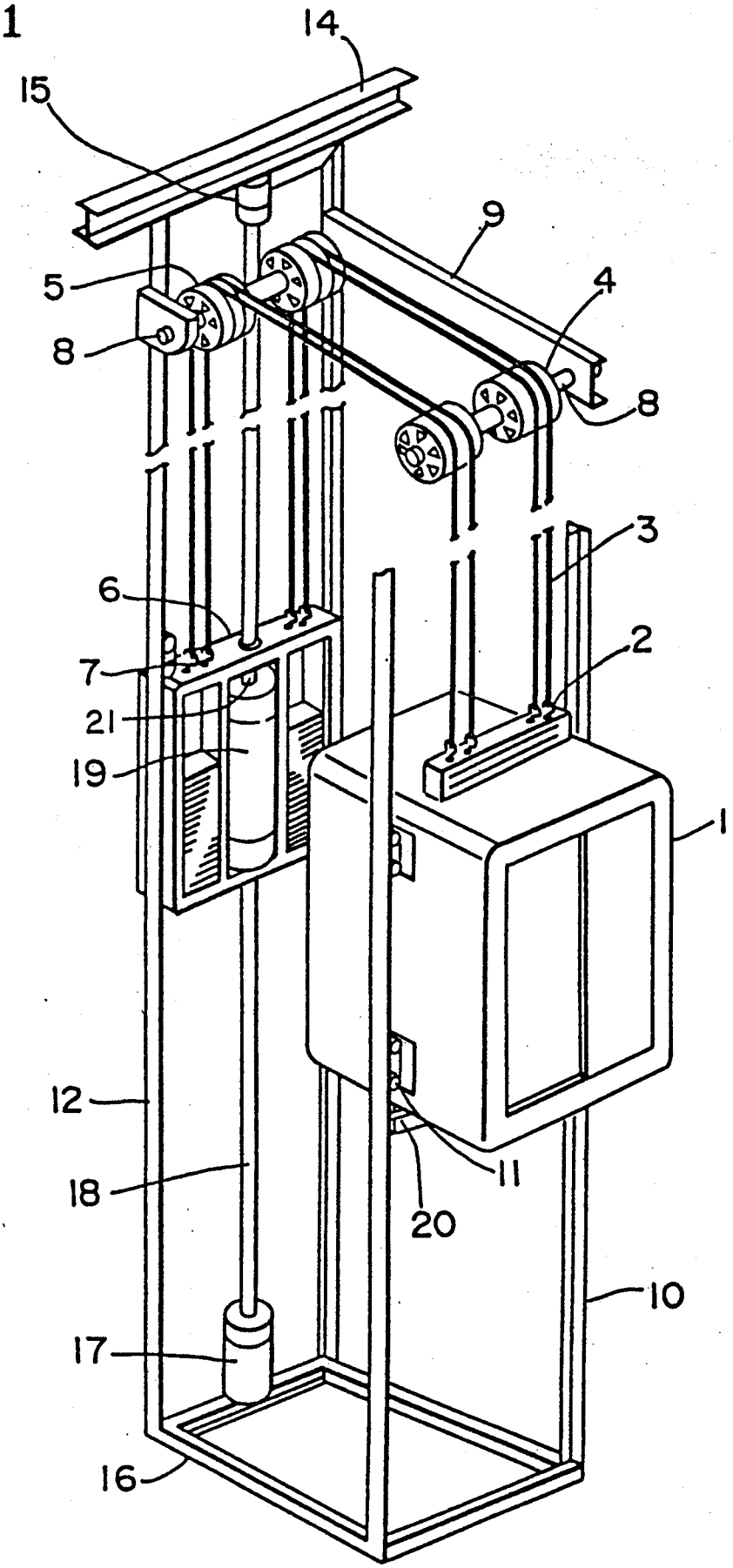
FIG. 1 is a perspective view of a linear motor driven elevator having a device for stopping the elevator according to embodiment of this invention.

Referring to FIG. 1, elevator car 1 is connected to one end of rope 3. The other end of rope 3 is connected via hooks 7 to the counterweight 6. The ropes 3 are guided by a first sheave 4 and a second sheave 5 which are rotatably supported by beam 9 via sheave shafts 8 at an upper travel path of the elevator. The car is disposed between guide rails 10 and is guided thereon by guide rollers 11. The counterweight 6 is disposed between guide rails 12 and is guided thereon by guide rollers 13. The counterweight 6 travels vertically along column 18.

The column, which is attached to a building (shown schematically as beam 14 and floor frame 16) via an upper end supporter 15 and a lower ends supporter 17, serves as a stator (secondary conductor) of a linear induction motor. The moving element (primary conductor) 19 has a central opening 21 for receiving the column. The moving element is secured within the counterweight 6, along a central axis thereof, to balance the counterweight.

As shown, the moving element is a primary conductor and the stator is a secondary conductor. Conversely, the motor may be exposed in such a manner of such that the primary conductor is the stator and the secondary conductor is the moving element. The embodiment shown utilizes a toroidal-type linear motor having a cylindrical coil within the moving element, but a planar-type linear motor as disclosed in Japanese Patent Laid Open Nos. 63-117884 and 59-64490 may be utilized as well.

The bottom of the car is provided with a braking device 20 for stopping the car at a floor upon request or in an emergency. Location of the braking device 20 may be similar to where the braking device is located in a conventional emergency braking system.

Figure 2:
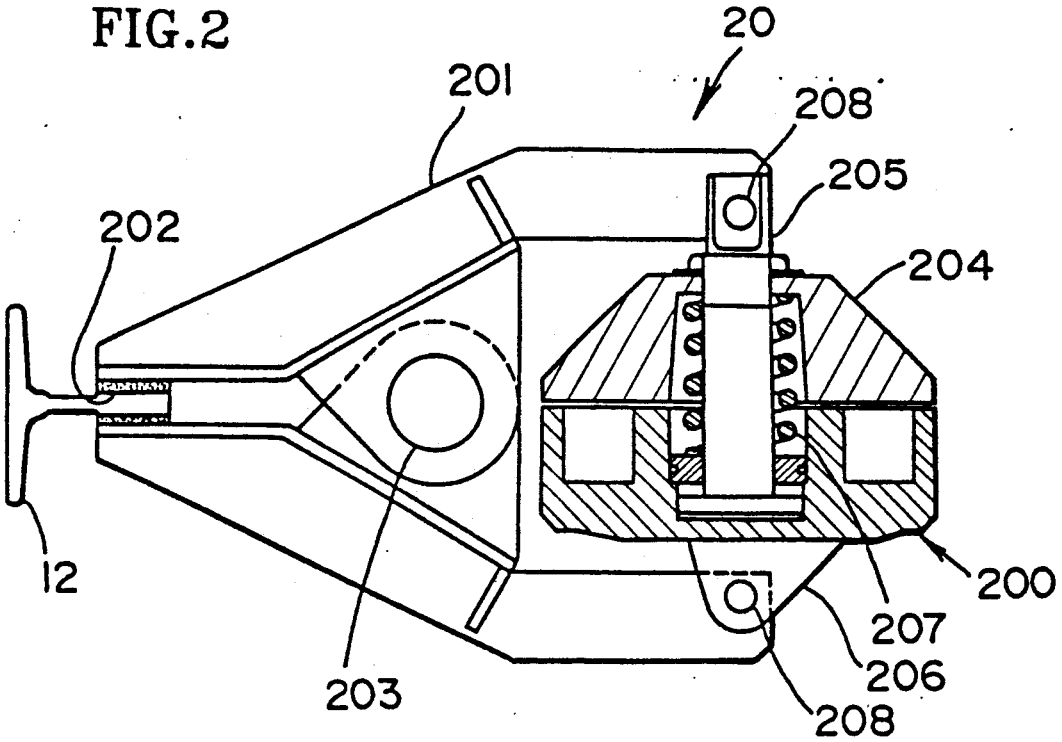
FIG. 2 is a plan view of a braking device used for stopping the elevator shown in FIG. 1.
Figure 3:
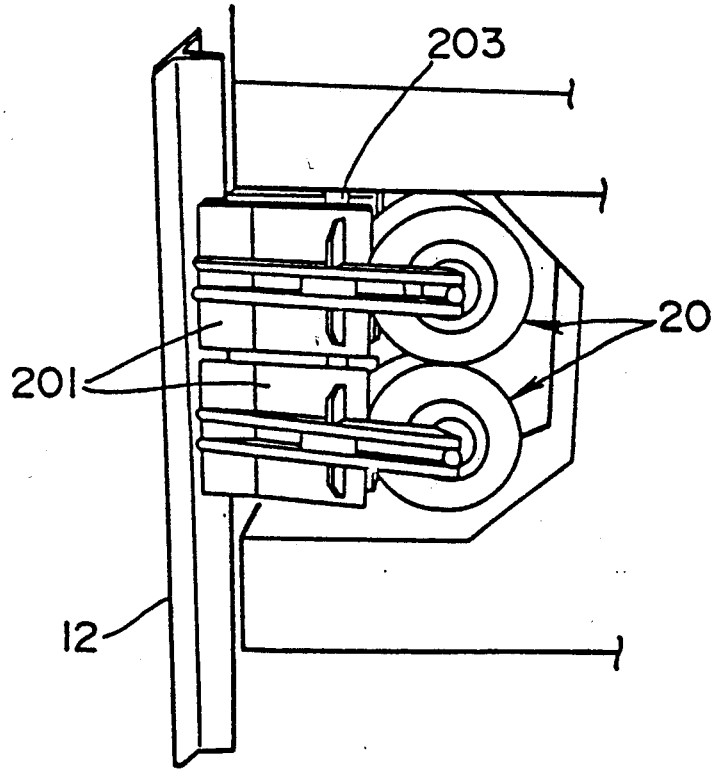
FIG. 3 is a perspective view showing the braking device of FIG. 2.

Referring to FIGS. 2 and 3, an example of the braking device 20 shown in FIG. 1 is provided. As shown, the braking device 20 has a pair of brake shoes 202 disposed at an end portion of a pair of brake arms 201. The brake arms 201 are rotatably mounted about a shaft 203. An actuator 200 is disposed at the right-hand side of the braking device for engaging the brake arms 200 and the brake shoes 202 with the guide rails 12 or disengaging the brake arms 200 and the brake shoes 202 with the guide rails 12.

The actuator comprises a coil 204, a core 205, bracket 206, and a compression spring 207. The actuator attaches to each brake arm by a pin 208 extending from core 205 and through bracket 206. The actuator 200 is connected to a power source (not shown). When the power source is switched on, the coil 204 is excited to cause the core to be magnetically pulled against the force of the spring 207. As a result, the brake arms 201 are pulled to disengage the guide rails 12. The brake shoes 202 are released from frictional engagement with the guide rail 12 so as to release the braking force which restricts the travel of the car. Conversely, when the brake unit is switched off by interrupting the power, the coil 204 is disabled causing the core 205 to be pushed from the coil by the force of the spring 207. The brake shoes then engage the guide rail 12. As a result, the braking force caused by the frictional engagement between the brake shoes and the guide rail stops the car. The embodiment shown employs an electromagnetic actuator, but may employ hydraulic or pneumatic actuators assuming the desired braking force is provided.

Figure 4:
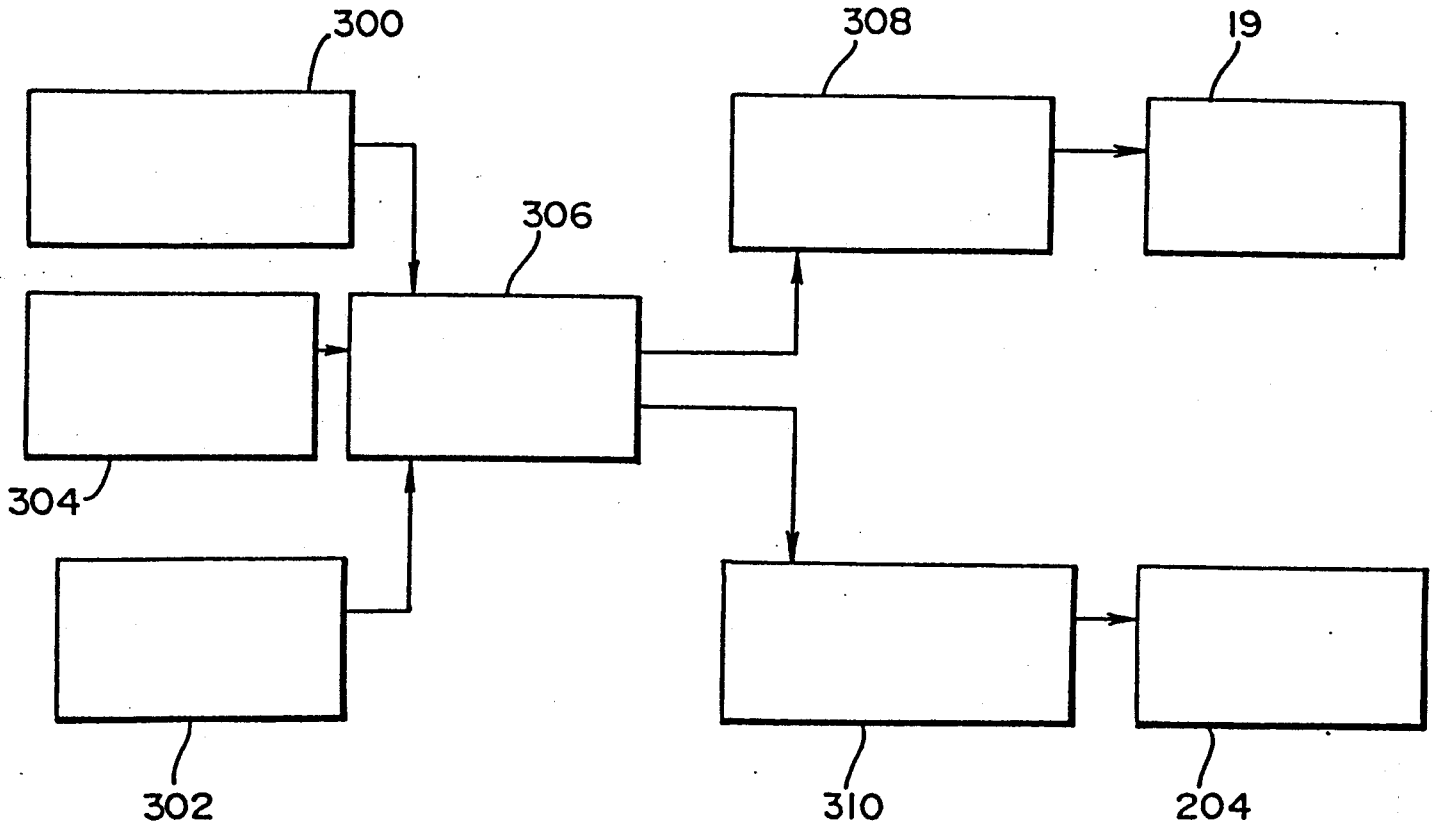
FIG. 4 is a block diagram showing a control system for controlling the device for stopping the elevator.

Referring to FIG. 4, the relationship between the braking device 20 and the linear motor is described. Car position detection means 300 includes a known car position signal detecting encoder. The detection means generates a car position signal showing a positional relationship between the car and each floor. Hall calling means 302 is a command device providing signals from hall call buttons provided in the hall on each floor. The hall calling means outputs a signal in accordance with the operation of an up or down button (not shown) as requested. A car calling means 304 includes a control panel (not shown) provided in the car. The car calling means outputs a signal indicating a requested floor in accordance with the operation of the button requesting a destination floor.

Control circuit 306 generates a control signal in accordance with; the car position signal generated by the car position detection means, the signal output by the hall calling means, and the signal output by the car calling means. The control circuit then outputs the control signal to a motor controlling means 308 which includes control elements such as an inverter (not shown). The motor controlling means feeds power to the moving element 19 for driving the car to the requested floor. While the car is travelling, the control circuit 306 compares the car position detection signal with the hall call signal or the car call signal. The control circuit outputs a control signal to the motor controlling means to interrupt power fed to the moving element 19 when the car arrives at a requested floor.

While feeding electrical power to the moving element, the control circuit continuously supplies a brake "off" command to a brake control means 310. The brake control means 310 continuously feeds electric power to the magnetic core 204 in accordance with the brake "off" command so as to retain the braking device 20 in the release position. Should the control circuit supply a brake "on" to the brake control means 310. The brake control means interrupts power to the magnetic core thereby actuating the braking device. The control means 306 continuously supplies the brake "on" command to the brake control means until the next hall call command or car call command is received.

The foregoing device facilitates control of car position because the braking device directly stops the car when the power fed to the linear motor is interrupted. Further, by providing the braking device in the car, the burden on the sheave located on the upper portion of the travel path is reduced. By providing the control means in the car, it is possible to maintain the control inside the car thereby improving the maintenance characteristics of the braking device.

The control system shown in FIG. 4 may be modified to change the timing between the activation of the motor and the activation of the braking device. It is therefore possible to activate the braking device slightly before the linear motor is deactivated and the braking device may be released slightly after the activation of the motor to improve the safety and comfort of the elevator. However, the control system is simpler by synchronously connecting the operation of the motor and the braking device.

The above embodiment of this invention merely provides a braking device in the car. The counterweight 6 may inertially overrun a stop position when the car stops, especially if the counterweight is travelling up. If the counterweight overruns the stop position and then travels freely downwardly to a balance position, an impact may be conveyed to the car via the rope. The elevator passengers may then feel uncomfortable.

Figure 5:
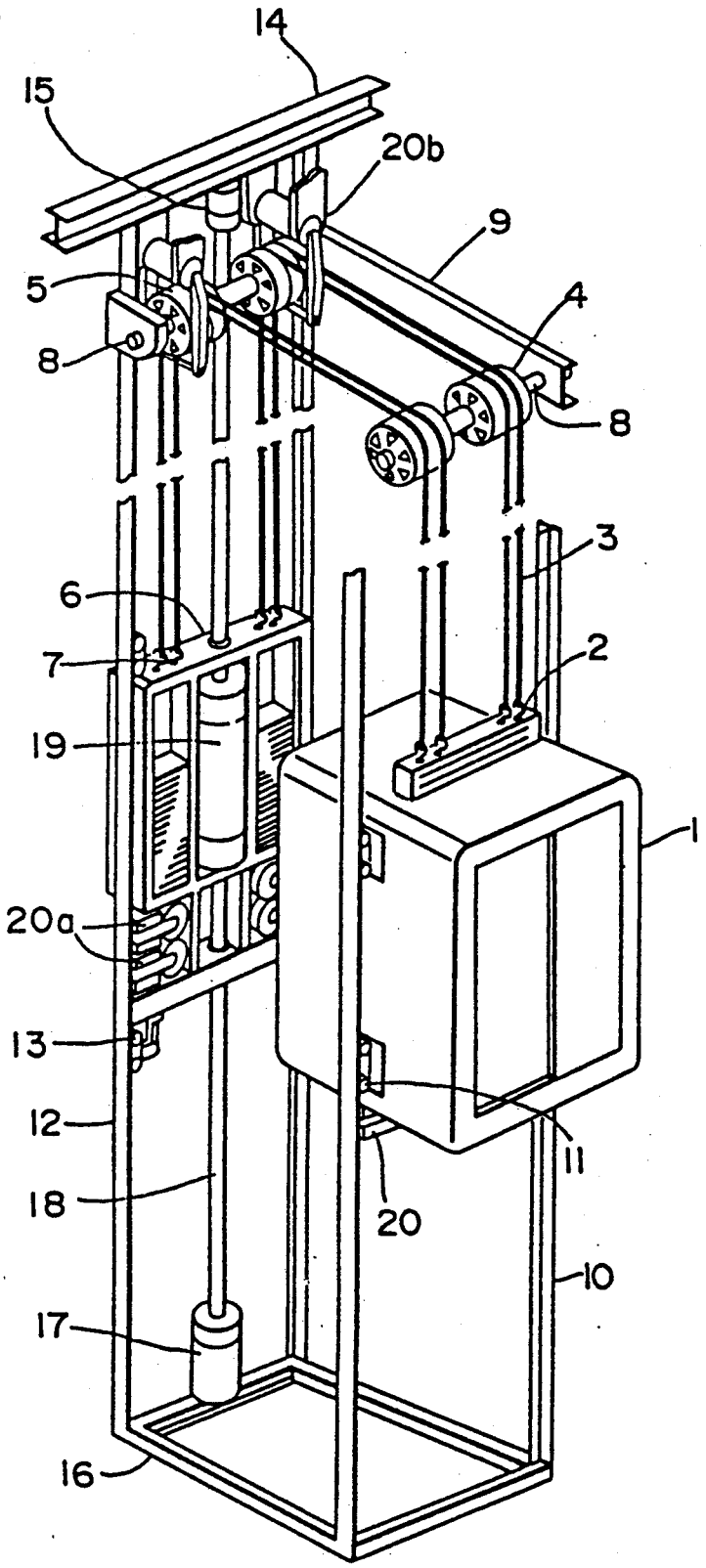
FIG. 5 is a schematic view showing a linear motor driven elevator having a device for stopping the elevator at a floor according to a second embodiment of this invention.

In order to avoid overrun, a braking device **20*a* is provided in counterweight 6, as shown in FIG. 5. The braking device 20*a*, which is similar to the braking device 20, has a smaller braking capability than the braking device provided in the car, because it is merely used for preventing counterweight overrun. The braking capability may be set by providing a spring force that is less than the spring used in braking device 20. Hence, the braking device 20***a* is not heavily loaded and is therefore less likely to fail. If the braking device stops the counterweight due to a failure, unlike the conventional device, the counterweight may be moved, against the relatively light braking force, to a position where maintenance may be performed safely.

Figure 6:
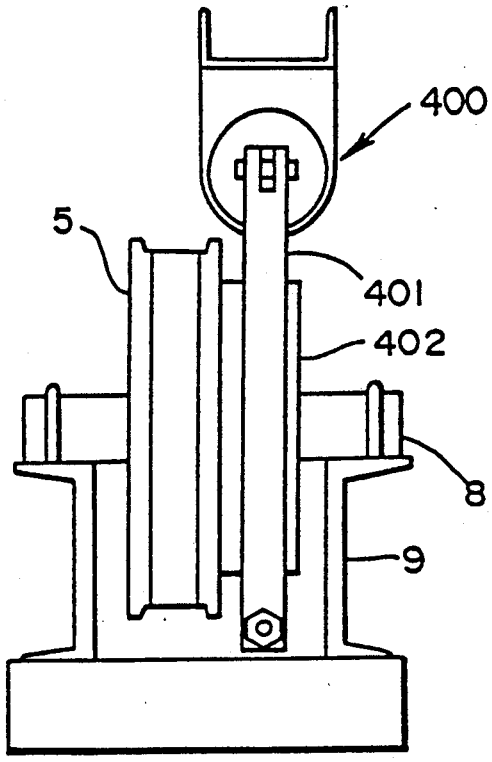
FIG. 6 is a plan view showing one example of a braking device provided for a sheave; and, FIG. 7 is a side view showing a braking device shown in FIG. 6.
Figure 7:
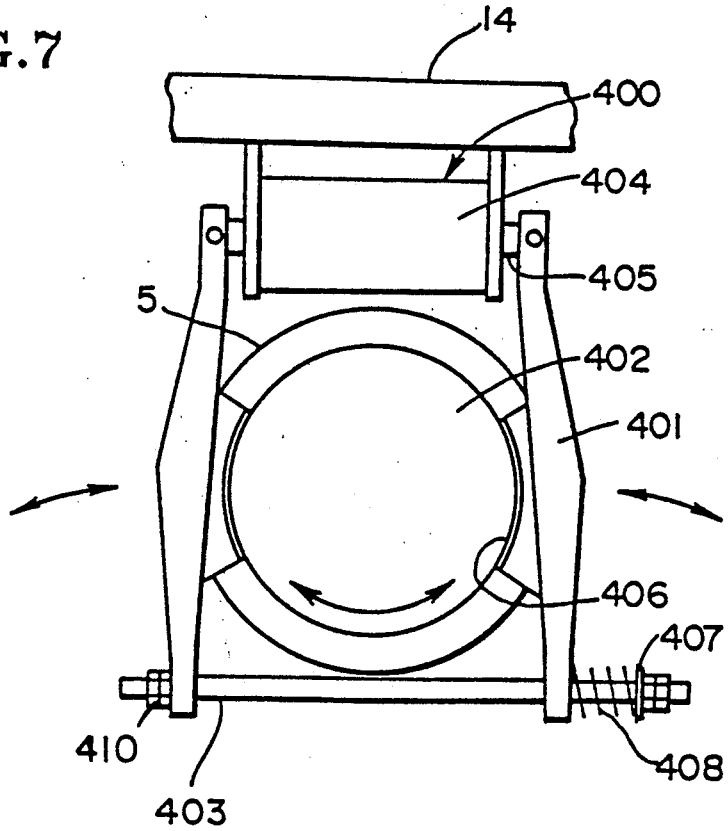

As shown in FIGS. 5–7, to reduce the load of the braking device provided in the car, a braking device 20*b* is provided upon the sheave. The braking device 20*b* comprises an electromagnetic brake unit 400 fixedly supported to a ceiling beam 14, a pair of brake arms 401, a brake drum 402 formed coaxially with sheave shaft 8, and a connecting shaft 403 for connecting the ends of the brake arms 401.

The electromagnetic brake unit comprises a coil 404 and a core 405. Each brake arm 401 has a brake shoe 406 provided thereon. Each brake shoe frictionally engages the brake drum 402. Each brake arm is received in an end of connecting shaft 403. The portion of the connecting shaft between the brake arms has a larger outer diameter than the ends outside the brake arms to define a contracting limit of the brake arms 401. The brake arms are prevented from coming off the shafts by nuts 410. The brake arms 401 are urged into contact with the brake drum by a compression spring 408 disposed against a spring seat 407. The compression spring pulls the brake arms towards the middle portion of the connecting shaft (and towards the drum). When the brake unit 400 is switched on, the core 405 translates 405 to allow the brake arms to rotate on the connecting shaft to release the brake shoes 406 from the brake drum 402. The braking force applied on the sheave 5, is released thereby. Conversely, when the brake unit 400 is switched off, as shown in FIG. 7, the core is pulled inside the coil by a spring (not shown) built in the brake unit, thereby applying a braking force to the sheave. When the car stops at a floor, therefore, the brake unit is in an "off" state, and the brake shoe move to brake the brake drum as above.

In this embodiment the braking device in the car and the braking device in the sheave act in concert to stop the car. A smaller braking load upon the sheave is required than in the prior art.

The foregoing embodiments were constructed to operate each braking device when the car stops at a floor. Yet, when abnormal conditions such as power outages interrupt the feed to each magnetic core, these braking devices operate to stop the car. As set forth above, according to this invention, by providing a braking device in the car, the machine room located at the upper travel path may be made smaller and simpler, or to be removed altogether thereby maximizing the use of space in the building. The braking device provided is easy to maintain because it may be checked and repaired inside the car. Moreover, by using a plurality of brakes, the load on each brake is diminished and the corresponding failure rates decrease. Further, by providing an auxiliary braking device in the counterweight, passenger discomfort caused by counterweight overrun is minimized.

Although the invention has been shown and described with the respect to a best mode embodiment thereof, it should be understood by those skilled in the art that the foregoing and various other changes, omissions, and additions in the form and detail thereof may be made therein without departing from the spirit and scope of the invention.

We claim:

1. An elevator system comprising;

a guide sheave disposed at a top of a travel path, a rope guided by said sheave and having a first end and a second end, a car suspended from said first end of said rope, a counterweight disposed from said second end of said rope, a linear motor for providing motive force to said system, said motor having a primary conductor and a secondary conductor, a braking means disposed upon said car for stopping said car, control means for feeding power to said primary conductor to provide motive force to the elevator system while feeding power to said braking means to deactivate said braking means from stopping said car, and for not feeding power to said primary conductor to remove motive force from the elevator system while not feeding power to said braking means to activate said braking means to stop said car; and an auxiliary braking device disposed upon said counterweight for preventing inertial travel thereof.

2. The elevator of claim 1 further comprising;

a rail for guiding said car, and said braking means having;

a brake shoe for frictionally engaging said rail and, an actuator for disengaging said brake shoe from said rail upon being fed power, and for engaging said brake shoe with said rail upon not being fed power.

3. The elevator of claim 1 wherein said control means further comprises;

means for engaging said braking means upon the interruption of power to said primary conductor.

4. The elevator system of claim 1 further comprising;

a second auxiliary braking device disposed upon said sheave for sharing a braking load with braking means.

5. The elevator of claim 1 wherein said control means feeds power to said primary conductor and to said braking means simultaneously and interrupts the feed of power to said primary conductor and to said braking means simultaneously.

6. The elevator of claim 1 wherein said control means feeds power to said primary conductor before feeding power to said braking means and interrupts the feed of power to said braking means before interrupting power to said primary conductor.

7. The elevator of claim 1 wherein said control means feeds power to said primary conductor before feeding power to said braking means.

8. The elevator of claim 1 wherein said control means interrupts the feed of power to said braking means before interrupting power to said primary conductor.

* * * * *